United States Patent [19]

Boggs et al.

[11] Patent Number: 4,509,726

[45] Date of Patent: Apr. 9, 1985

[54] BARRIER

[75] Inventors: William G. Boggs, Phoenix; David S. VanDenburgh, Paradise Valley; Gabriel A. Valdez, Tolleson, all of Ariz.

[73] Assignee: American Security Fence Company, Phoenix, Ariz.

[21] Appl. No.: 542,513

[22] Filed: Oct. 17, 1983

[51] Int. Cl.[3] ..... B21F 25/00

[52] U.S. Cl. ..... 256/8; 256/2

[58] Field of Search ..... 256/2, 3, 4, 5, 6, 7, 256/8, 9

[56] References Cited

U.S. PATENT DOCUMENTS

| | | | |
|---|---|---|---|
| Re. 30,814 | 12/1981 | Mainiero | 72/294 |
| 2,908,484 | 10/1959 | Uhl | 256/8 |
| 3,455,539 | 7/1969 | Loofbourrow | 256/8 |
| 3,463,455 | 8/1969 | Meckel | 256/8 |
| 3,763,529 | 10/1973 | Musgrave | 256/8 X |
| 3,916,958 | 11/1975 | Uhl | 140/4 |
| 4,040,603 | 8/1977 | Mainiero | 256/8 |

*Primary Examiner*—Andrew V. Kundrat

*Attorney, Agent, or Firm*—Cahill, Sutton & Thomas

[57] ABSTRACT

A metal tape barrier has a generally constant edgewise arcuate curvature and a channel providing a lengthwise bight having a reinforcing wire therein. The tape wraps from about 200° to about 220° of the periphery of the wire, just sufficient to hold the wire in place. Continuous flange regions of the tape extend outwardly of the channel and cooperate with the channel and the reinforcing wire to impart strength to the barrier so that it is self-supporting and is resistant to being collapsed. The tape has barbs formed outwardly of the flange regions and reduced width regions of the flange regions at the roots of the barbs enhance the penetration capabilities of the barbs.

4 Claims, 4 Drawing Figures

BARRIER

TECHNICAL FIELD

This invention relates to security barriers of the type employed to prevent unauthorized entry or exit of people from secure facilities, such as armed forces installations, correctional institutions and commercial and industrial storage areas.

BACKGROUND ART

It has long been the practice to enhance physical security at various installations by providing barriers constructed of barbed entanglement devices. These barriers usually take the form of helical coils of barbed materials which are placed atop walls and fences or arranged in stacked arrays between walls or fences. The oldest, and most common, form of barbed barrier is that made from barbed wire. Characteristically, barbed wire is only barely self-supporting and therefore can be crushed from a coil form with very little effort. Such barriers usually can be breached with very simple aids such as a heavy cloth or a board. Moreover, the rather flimsy appearance of the barbed wire and the fairly short, non-lethal, barbs thereon, often fail to discourage a person from attempting to breach the barrier. It has thus been recognized that for secure installations more rugged and more intimidating barriers are required. This has led to the development of barbed tape barriers.

There are two types of barbed tape in common use today. The first of these usually is referred to as "Barbed Tape Concertina" and is formed by clinching a strip of barbs over a high tensile, spring steel wire which is preformed to the desired helical configuration. This type of tape is disclosed in U.S. Pat. No. 2,908,484 granted Oct. 13, 1959 to S. Uhl for "BARBED WIRE SPIRAL" and U.S. Pat. No. 3,916,958 granted Nov. 4, 1975 to S. Uhl for "PROCESS AND APPARATUS FOR PRODUCING A BARBED SPIRAL". One disadvantage to this type of barbed tape is its cost, which is relatively high because of the requirement that spring quality steel be used for the supporting wire core of the tape. This tape is also deficient in its performance because the barrier coils are relatively weak in vertical compression. Even though it is the usual practice to clip together adjoining coils at spaced intervals to impart structural integrity to the barrier, simple breaching aids usually are sufficient to subvert the purpose of the barrier. Lastly, the short barbs usually provided on this type of tape and the "skinny" appearance of the tape render the tape only slightly more intimidating than ordinary barbed wire. Thus this tape fails to discourage attempts to breach it.

The other form of barbed tape in common use today is that known generally by its military designation of "General Purpose Barbed Tape Obstacle". This barrier consists of a unitary flat metal strip which is bent edge wise in the form of a helix and has portions cut away so that elongated barbs are provided at spaced intervals along the two edges of the strip. In some of these barriers, the strip is formed with a continuous uniform arcuate curvature as disclosed in U.S. Pat. No. 3,463,455 granted Aug. 26, 1969 to P. T. Meckel for "HELICAL BARBED TAPE UNIT". Other barriers of this type are formed by edge bending the strip into identically angularly displaced adjoining linear segments to form the helix. Such a tape is disclosed in U.S. Pat. No. 4,040,603 granted Aug. 9, 1977 to M. R. Mainiero for "BARBED METAL TAPE". The method for manufacturing this tape is disclosed in U.S. Pat. No. Re. 30,814 reissued Dec. 8, 1981 to M. R. Mainiero for "APPARATUS AND METHOD FOR FORMING BARBED TAPE". The Meckel patent and the Mainiero patents disclose techniques for providing shallow reinforcing channels or grooves throughout the linear extent of the tape strip, presumably for the purpose of rigidifying the resulting barrier. Norwithstanding such reinforcement, barriers formed in the manner taught by Meckel and Mainiero are required to be fabricated from either expensive, spring quality, austenitic stainless steel material or of lower quality steel in a thicker strip in order to possess sufficient strength to resist collapsing forces from breach attempts. Furthermore, in order to control bending of the strip of metal stock used to manufacture the Mainiero tape, it is usually necessary to punch holes in the tape at the bend locations and such holes further weaken the tape in edgewise bending.

The prior art also includes other barbed tape structures which have met with little or no commercial success. One such barbed tape is disclosed in U.S. Pat. No. 3,455,539 granted July 15, 1969, to J. G. Loofbourrow for "BARBED STRIP", which is required to be made of spring steel. U.S. Pat. No. 3,763,529 granted Oct. 9, 1973 to D. D. Musgrave for "METHOD OF FABRICATING BARBED TAPE" suggests reinforcing a barbed tape with wire which is secured to the tape either by welding or by having spaced segments of the tape bent around the wire. Both of these techniques appear to be costly and impractical.

DISCLOSURE OF INVENTION

The barbed tape barrier of this invention possesses the visual intimidation of former General Purpose Barbed Tape Obstacle barriers, but is designed to be stronger than the former barriers and also less expensive because of lower manufacturing and raw material costs.

The barrier structure of this invention is made from an elongated metal tape having a generally constant edgewise arcuate curvature therein such as can be produced on continuous flow manufacturing equipment. This feature contributes to the lower manufacturing costs of the tape as contrasted, for example, with the stop and start manufacturing technique required to produce the segmented Mainiero tape mentioned above. The tape of this invention has a channel formed lengthwise therein which provides a bight to receive a reinforcing wire. The tape channel is deformed slightly to grip the reinforcing wire uniformly along its length, preferably around no more than from about 200° to about 220° of the periphery of the wire. In other words, the wrap of the tape channel about the wire is only that necessary to hold the wire in place, leaving a substantial surface area of the wire exposed. The tape is formed to provide continuous reinforcing flange regions extending from opposite sides of its channel and these reinforcing flange regions have formed outwardly thereof barbs which are of substantial and ominous lengths for maximum intimidation. The flange regions of the tape in the vicinity of the barb roots may be reduced so as to open up the tape in the vicinity of those roots to enhance the penetration capability of the barbs and make the tape more effective against a person attempting to breach it.

Like most barriers intended for use outdoors, it is preferred that the tape of this barrier be made from stainless steel so that the barrier resists deterioration. However, because of the strength imparted to the tape by the combined effects of the channel, the flange regions and the reinforcing wire, it is possible to manufacture the improved barrier of this invention from fairly thin, non-spring quality metal, which is less expensive than spring quality metal. Indeed, a highly effective and highly reliable form of barrier can be constructed in accordance with this invention utilizing ordinary galvanized, non-spring quality, steel reinforcing wire. Now the presence of two different metals in the tape offers some risk that the tape will be subject to deterioration from corrosion in the presence of moisture. However, the limited wrap of the reinforcing wire by the channel portion of the tape minimizes the area of contact between the tape and the wire. And the relatively wide open mouth to the bight of the tape channel allows moisture to escape from the bight. Thus, it can be expected that the tape barrier of this invention will have an extended life, notwithstanding the utilization of inexpensive galvanized reinforcing wire as a principal component thereof.

BRIEF DESCRIPTION OF THE DRAWINGS

The following detailed description of the invention makes reference to the accompanying drawings wherein.

BEST MODE FOR CARRYING OUT THE INVENTION

Figure 1:
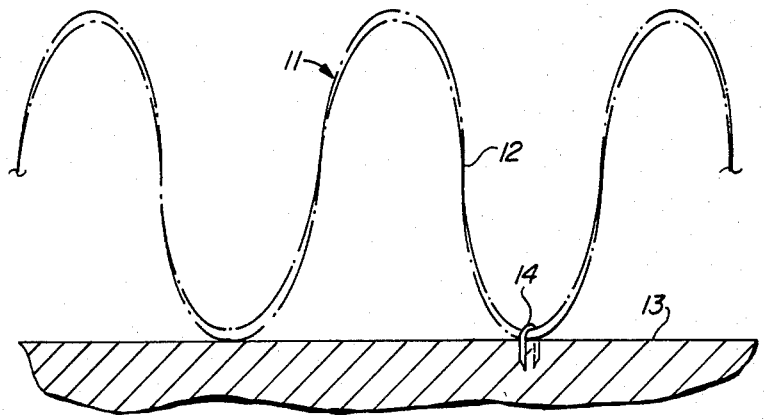
FIG. 1 is a diagrammatic vertical elevation view of a barbed tape barrier embodying this invention. The barbs and other details of the tape have been omitted to simplify the drawing.

The physical security barrier illustrated in FIG. 1 and designated generally by reference numeral 11 consists of a barbed tape 12 made from a strip of metal which has been bent edgewise, i.e., in its own plane, to provide a constant edgewise arcuate curvature resulting in a series of interconnected coils of equal diameter. The coils form a helix. The barrier 11 is frequently used with other wall structures or fences, indicated at 13, to control entry and exit of personnel from secure areas. As shown, the barrier is often mounted atop the wall, or fence 13, and held in place by means of fasteners 14.

Barbed tape 12 of barrier 11 has a number of barbs (not shown in FIG. 1) formed on the inner and outer edges thereof for presentation to a person attempting to breach the barrier. The barbs are numerous and because of the helical disposition of the tape 11, present themselves in a variety of directions so as to be available to become entangled in the clothing and flesh of a person who attempts to breach the barrier. Such barriers typically will have a diameter of from about 46 cm (18 in.) up to about 86 cm (34 in.) although barriers constructed in accordance with this invention can be made considerably larger in diameter if that is desired. To facilitate transportation of the barrier from the manufacturer to the site of its use, the coils of the helix are normally collapsed against each other and the barrier is erected by stretching the helix to separate the coils. A typical barrier may have an erected length of from 15 m (50 ft.) to 19.8 m (65 ft.).

It can readily be appreciated that the strength of barrier 11 is extremely important, particularly the strength to resist being collapsed from downwardly applied forces such as might be generated by a plank being placed across the barrier by someone attempting to breach the barrier. The edgewise bending strength of the barbed tape is therefore extremely important in maintaining the integrity of the barrier. Although less obvious, the appearance of the barrier 11 also is important. Not only should a barrier of the type involving this invention be capable of actually resisting an attempted breach, but is should have the capability of discouraging a person from even attempting the breach. The barrier therefore should have an appearance of substance and strength and present for clear view numerous ominous and intimidating barbs having the apparent capability of inflicting serious wounds to a person attempting to breach the barrier. As mentioned previously, barbed wire and the Concertina form of barbed tape are lacking in these desirable appearance characteristics.

Figure 2:
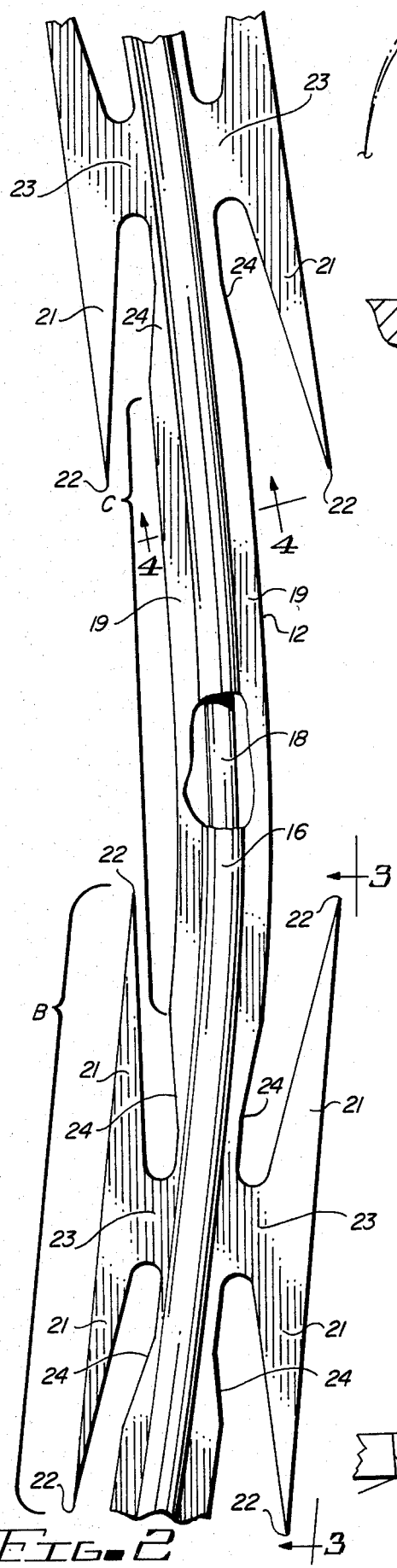
FIG. 2 is an enlarged view of one face of a barbed tape embodying this invention and having portions broken away to illustrate the reinforcing wire therein.
Figure 3:
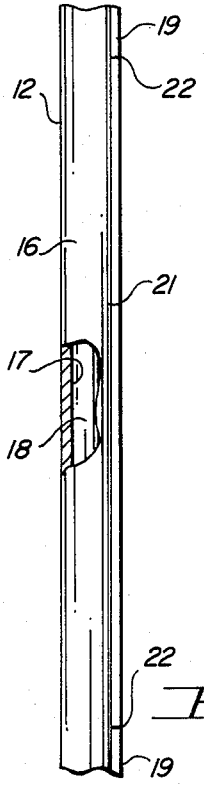
FIG. 3 is an edge view of the tape taken as indicated by the line 3—3 in FIG. 2.
Figure 4:
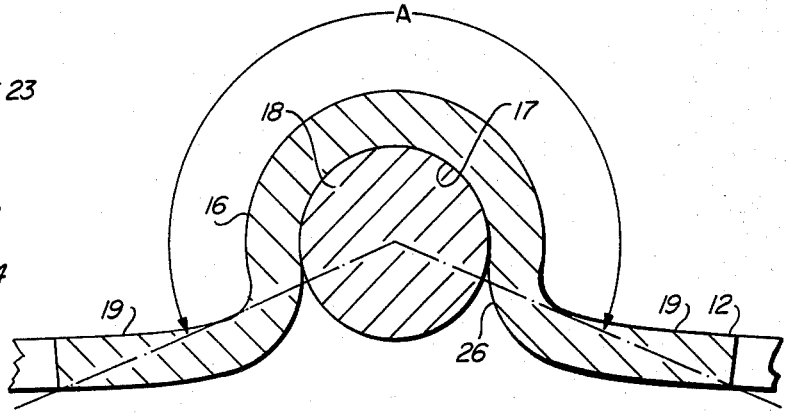
FIG. 4 is an enlarged cross sectional view through a portion of the barbed tape taken as indicated by the line 4—4 in FIG. 2.

The details of construction of the barbed tape 12 of this invention are illustrated in FIGS. 2 to 4. Tape 12 is formed of a flat strip of corrosion resistant sheet metal, such as stainless steel. Barriers within the diameter range previously mentioned can be formed of sheet metal having a thickness of 0.635 mm (0.025 in.) and an initial width of approximately 2.5 cm (1 in.). The middle region of tape 12 has formed therein a channel 16 providing a bight 17 for receiving a reinforcing wire 18. For barrier configurations of the size discussed above, reinforcing wire 18 should have a diameter of approximately 2.5 mm (0.098 in.) and may be made from an inexpensive, galvanized, non-spring quality steel material. In accordance with this invention, the tape channel 16 is pinched about reinforcing wire 18 only over a sufficient portion of the periphery of the wire to minimally hold the wire in place within bight 17. This peripheral gripping preferably engages an arc of from about 200° to about 200° and is uniform along the length of wire 18 and the tape 12. The extent of gripping engagement between the tape 12 and reinforcing wire 18 is indicated as angle A in FIG. 4.

Barbed tape 12 is preferably further configured to provide flange-like reinforcing regions 19 extending outwardly from channel 16. The flange regions 19 cooperate with channel 16 and reinforcing wire 18 to impart strength and rigidity to the barbed tape 12. The flange regions 19 further add visual substance to the tape, giving the appearance of strength. The combined overall width from edge to edge of the flange regions 19 and the channel 16 for a barrier constructed in accordance with this invention will typically be about 8.7 mm (11/32 in.).

The barbed tape 12 is also formed, as by stamping, to provide a plurality of barbs 21 thereon. The barbs 21 preferably appear as spaced clusters of four barbs with a pair on one side directly opposite another pair on the other side. It can be appreciated, however, that the tape 12 may, if desired, be provided with barbs only along one edge instead of both edges. The barb clusters for a typical barrier are spread on 10.2 cm (4 in.) centers. Barbs 21 are provided with extremely sharp points 22 and the distance between points, indicated by dimension B, is considerable, i.e. of the order of 6 cm ($2\frac{3}{8}$ in.). The barbs 21 are joined to the flange regions 19 of the tape by means of root sections 23 which are quite narrow in comparison with the distance between barb points 22 thus giving the shank section of the barbs considerable length and permitting the points 22 on the barbs to penetrate deeply into any material which comes in contact with the tape. It is preferred, in order to further enhance the penetrating capability of the barbs 21, that portions of the flange region 19 be reduced in width, as indicated at 24, adjacent the root sections 23 of the barbs 21. Thus, the barbs 21 can enter any interfering material up to the hilt, so to speak, without interference from the reinforcing flanges 19 on the tape. Similar results could be achieved by increasing the length of the barb roots, but this would require the use of a wider and more expensive tape blank. This reduction in width of the reinforcing flange in regions 24 does not significantly decrease the strength or stiffness of the tape in this region because of the presence of the barb roots 23 and the barbs 21 which tend to reinforce and strengthen the tape in their regions.

If, as is preferred, the linear extent of the wider flange reinforcing regions 19 intermediate the barb clusters (dimension C in FIG. 2) is designed so that it is equal to dimension B, i.e., the distance between the points on a pair of barbs, this will simplify the manufacture of the tape 12. When interdigitating adjacent tape blanks are stamped from a single strip of base material, a single series of slits formed in the base material can produce an edge of reinforcing region 19 on one tape blank and the outer edge of a pair of barbs 21 for the adjoining tape blanks.

Tape 12 is initially blanked in flat configuration to a width of approximately 2.5 cm (1 in.) from barb edge to barb edge. This tape will have a finished width dimension of approximately 2.1 cm (13/16 in.) after being shaped and pinched to affix reinforcing wire 18 in place.

As mentioned previously, the formation of channel 16 in tape 12 is such as to minimally grip and retain reinforcing wire 18 in place therein. It is desirable that as much surface area of the reinforcing wire 18 remain unconfined as is possible. Because the tape 12 and the reinforcing wire 18 are preferably made of dissimilar metals, i.e., stainless steel and galvanized steel, it is possible that galvanic action might cause some corrosion in areas where these two materials are in contact if moisture is present. And, of course since these barriers are intended for outdoor installation, it is inevitable that moisture will from time to time be present. But with the minimum gripping area provided between channel 16 and reinforcing wire 18, there is provided a large mouth 26 to the bight region 17 of the channel allowing for ventilation and drying of the bight region and the reinforcing wire 18.

From the foregoing, it should be apparent that this invention provides an improved security barrier capable of being constructed at low cost and which is effective to discourage and resist human breach.

What is claimed is:

1. A self-supporting barrier structure comprising an elongated metal tape having a generally constant edgewise arcuate curvature therein providing a series of interconnected coils of equal diameter, said tape having a channel formed lengthwise therein and providing a bight, a reinforcing wire disposed in the bight and uniformly gripped by said tape throughout its length, said tape further having continuous reinforcing flange regions extending from opposite sides of said coil channel and barbs formed at spaced intervals along said tape and extending outwardly of the extent of said flange regions, said barbs formed in pairs with the individual barbs in each pair extending in opposite directions and each pair having a root portion connecting the pair to the flange region of the tape, the width of the flange regions of the tape adjacent each barb root being narrower than the wider flange regions elsewhere along the tape.

2. The barrier structure of claim 1 wherein the distance between the points on each pair of barbs is equal to the length of the wider flange regions between barb pairs.

3. A self-supporting barrier structure comprising an elongated metal tape having a generally constant edgewise actuate curvature therein providing a series of interconnected coils of equal diameter, said tape having a channel formed lengthwise therein and providing a bight, a reinforcing wire disposed in the bight and uniformly gripped by said tape throughout its length, said tape further having continuous reinforcing flange regions extending from opposite sides of said coil channel and barbs formed at spaced intervals along said tape and extending outwardly of the extent of said flange regions, said reinforcing wire gripped by said tape around from about 200° to 220° of the periphery of the wire, said barbs formed in pairs with the individual barbs in each pair extending in opposite directions and each pair having a root portion connecting the pair to the flange region of the tape, the width of the flange regions of the tape adjacent each barb root being narrower than the wider flange regions elsewhere along the tape.

4. The barrier structure of claim 3 wherein the distance between the points on each barb pair is equal to the length of the wider flange regions between the barb pairs.

* * * * *

UNITED STATES PATENT AND TRADEMARK OFFICE

Certificate

Patent No. 4,509,726 Patented April 9, 1985

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is William G. Boggs, David S. Van Denburgh, Gabriel A. Valdez and Don W. Boness.

Signed and Sealed this 28th Day of October, 1986.

BRADLEY R. GARRIS,
*Office of the Deputy Assistant Commissioner for Patents.*